US006206053B1

(12) United States Patent
Hillegonds

(10) Patent No.: US 6,206,053 B1
(45) Date of Patent: Mar. 27, 2001

(54) CABLE TIE TENSIONING AND SEVERING TOOL

(75) Inventor: Larry Hillegonds, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 09/430,910

(22) Filed: Nov. 1, 1999

(51) Int. Cl.[7] ..... B21F 9/02
(52) U.S. Cl. ..... 140/123.6; 140/93.2
(58) Field of Search ..... 140/93 A, 93.2, 140/123.6

(56) References Cited

U.S. PATENT DOCUMENTS 3,254,680 6/1966 Caveney et al. .
3,661,187 5/1972 Caveney et al. .
4,793,385 12/1988 Dyer et al. .
4,997,011 3/1991 Dyer et al. .
5,492,156 2/1996 Dyer et al. .
5,915,425 6/1999 Nilsson et al. .

FOREIGN PATENT DOCUMENTS

WO98/08635 3/1998 (WO) .

*Primary Examiner*—Lowell A. Larson
(74) *Attorney, Agent, or Firm*—Robert A. McCann

(57) ABSTRACT

A tool for installation of a cable tie having a housing for supporting tensioning, cutting, actuating and restraining mechanisms. The actuating mechanism applies motivation support simultaneously to the tensioning and cutting mechanisms. The restraining mechanism, however, prevents actuation of the cutting mechanism until the desired predetermined tension is achieved. A ball detent assembly is at least included in the restraining mechanism for engaging the cutting mechanism sleeve with a circumferential force.

40 Claims, 12 Drawing Sheets

CABLE TIE TENSIONING AND SEVERING TOOL

TECHNICAL FIELD

The present invention relates generally to hand-held cable tie tensioning and severing tools, and more particularly, to an improved tool for reliably installing or applying high tension to flexible cable ties and severing the cable tie tails thereof without over tensioning the cable tie.

BACKGROUND OF THE INVENTION

As is well known to those skilled in the art, cable ties, or straps are used to bundle or secure a group of articles such as electrical wires and cables. Cable ties of conventional construction include a cable tie head and an elongated tail extending therefrom. The tail is wrapped around a bundle of articles and thereafter inserted through a passage in the head. The head of the cable tie typically supports a locking element which extends into the head passage and engages the body of the tail to secure the tail to the head.

In practice, the installer manually places the tie about the articles to be bundled, inserts the tail through the head passage and then manually tightens the tie about the bundle. At this point, a cable tie installation tool is used to tension the cable tie to a predetermined tension. One or more grip strokes may be needed to sufficiently tension the tie depending upon how tightly the installer manually tensions such tie. Once the strap tension approaches the desired predetermined tension setting level, the tool severs the excess tail portion from the tie, i.e., that portion of the tail which extends beyond the head of the cable tie.

The tools of the prior art, although capable of tensioning and thereafter severing the excess tail portion of the cable tie, typically have several disadvantages associated therewith which, either singularly or plurally, increase operator injuries due to poor ergonomics, or result in tool failure or degradation of reliability such that consistent proper installation of a cable tie becomes impossible. For example, the cast metal body tool disclosed in U.S. Pat. No. 3,661,187 to Caveney et al., uses a conventional linkage style tensioning and severing assembly. The design of this tool housing is not very ergonomic, but operatively, the linkage design is extremely durable. The cast metal body provides apertures in which pins or shafts are secured to mount and provide pivot points for the many linkage arms. Since the linkage style of tensioning and severing assembly generates such high forces at the pin locations and cantilevered loads, the durable cast metal body becomes a necessity for reliable operation and to keep the pins from distorting the housing and migrating. Using the stored energy principle of a partially compressed spring, accurate and predictable severance breakaway is achieved when the pins cannot move and the arms move through their indented movements. However, a disadvantage of the cast metal body is that it requires a significant number of manufacturing steps, driving the cost higher.

Other prior art examples include U.S. Pat. Nos. 4,793,385, 4,997,011, and 5,492,156, all to Dyer et al., which disclose a plastic bodied tool having improved ergonomics. A conventional linkage style arrangement similar to that disclosed in Caveney et al., is used, but the tension adjustment assembly has been moved to the top of the tool. In this location, the operator can easily see and manipulate the tension adjustment knobs. Additionally, a more deeply curved handle is shown, however, in practice the foam handle cover used therewith yields a final result which is not a very ergonomic. The major disadvantage of this tool is the incorporation of the high angular force linkage design, known previously, with the plastic body. As a result of this combination, the tool is not nearly as durable as previous designs. The high off-center loading forces of the linkage design are exerted on the pins mounted in the plastic body. As the number of use repetitions of the tool increase, the pin holes become elongated and allow the pins to migrate or wobble. Consequently, the clear breakaway point which commonly distinguishes the linkage style design becomes unpredictable and correct tensioning is not possible. Not only does this give the tool operator a vague sense of the proper tension, but inaccurate and inconsistent tensioning of the cable tie strap is also a result. Ultimately, this tool will fail to produce any reasonably repeatable results, after which the tool must be discarded as unusable.

The most recent prior art tool described in U.S. Pat. No. 5,915,425 to Nilsson et al., proposes to solve several ergonomic disadvantages of prior tools, namely, adjustable grip size, rotatable nose, and reduced recoil shock/vibration. While attempting to overcome these disadvantages, the plastic bodied tool incorporated a variation on tensioning and severing assemblies previously disclosed. However, this design in practice has resulted in a poorly performing tool that is not durable, subject to tensioning inaccuracies between tools, fails to provide a clear breakaway on cutoff, has the inability to accurately calibrate the tension settings, and uses a fragile tension setting device.

There is therefore a need in the art for an installation tool which is ergonomic, reliable, durable, provides a consistent cutoff height, comprises a lightweight plastic housing, and provides a clear cutoff breakaway point.

SUMMARY OF THE INVENTION

The present invention, which addresses the needs of the prior art, relates to a tool for installation of a cable tie. The cable tie includes a head and elongate tail extending therefrom. The tool includes a generally pistol-shaped housing. The housing operatively supports a tensioning mechanism for tensioning the cable tie to a predetermined tension setting and a cutting mechanism for severing the excess portion of the tail from the tensioned cable tie. The housing includes a fixed handle and a grip or trigger cooperating with the handle whereby movement of the trigger with respect to the handle operates tensioning and cutting mechanisms. A circumferentially restraining means which prevents actuation of the cutting mechanism prior to the cable tie tension reaching the previously desired predetermined tension setting. After the desired tension is achieved, the restraining means releases the cutting mechanism which severs the cable tie tail from the cable tie head.

One of the important objects of the present invention is to provide a highly-improved handtool for quickly and economically applying flexible ties or straps of the foregoing kind to bundles of wire and the like and for thereupon severing the free or loose ends of the ties, the tool having highly-improved mechanisms for applying successive straps at uniform predetermined tensions, resulting in consistent cut-off heights, using an ergonomically-shaped, lightweight plastic housing which achieves these objects no matter how the tool is gripped by the user.

Another important object of the present invention is to provide a strap tensioning and severing tool having a tensioning mechanism for progressively tensioning the tie, cutting mechanism for actuating a strap severing blade, and actuating mechanism for applying motivation force to both the tensioning and cutting mechanisms, wherein an additional restraining means is employed for applying a circumferential force upon the cutting mechanism to prevent blade severing movement thereof until a predetermined tension is reached in the strap. Additionally, the restraining means further includes an assembly for substantially reducing or releasing the restraining force on the cutting mechanism when the predetermined tension in the strap is reached, whereby the cutting mechanism thereupon immediately and quickly actuates the blade to sever the strap, thus insuring that successfully applied straps will be tensioned accurately and uniformly while giving the operator a clear indication of the breakaway point.

Still another important object of the present invention is to provide, in a hand tool having the attributes described above, relatively simple and highly-improved mechanism for bringing about the tensioning and severing of the straps, which includes concentrically, coaxially mounted tension rod, cutting mechanism sleeve and restraining means for reducing high off-center loads.

Another important object of the present invention is to provide a cable tie installation tool having a restraining means comprised primarily of a ball detent assembly which prevents movement of the cutting mechanism until the desired predetermined tension setting is achieved in the cable tie, whereupon a clear, distinctive breakaway is generated.

Yet another object of the invention is to provide a strap tensioning and severing tool of the foregoing kind which is relatively inexpensive to manufacture, entirely reliable in its use, very durable, and comfortable and convenient for use.

Still yet another object of the present invention is to provide an improved hand-held tie tensioning and severing tool for reliably tensioning cable ties by gripping either a flat surface or a serrated surface of a cable tie tail.

These and other object, features and advantages of the present invention will be clearly understood through a consideration of the following detailed description.

DETAILED DESCRIPTION OF THE INVENTION

Figure 1:
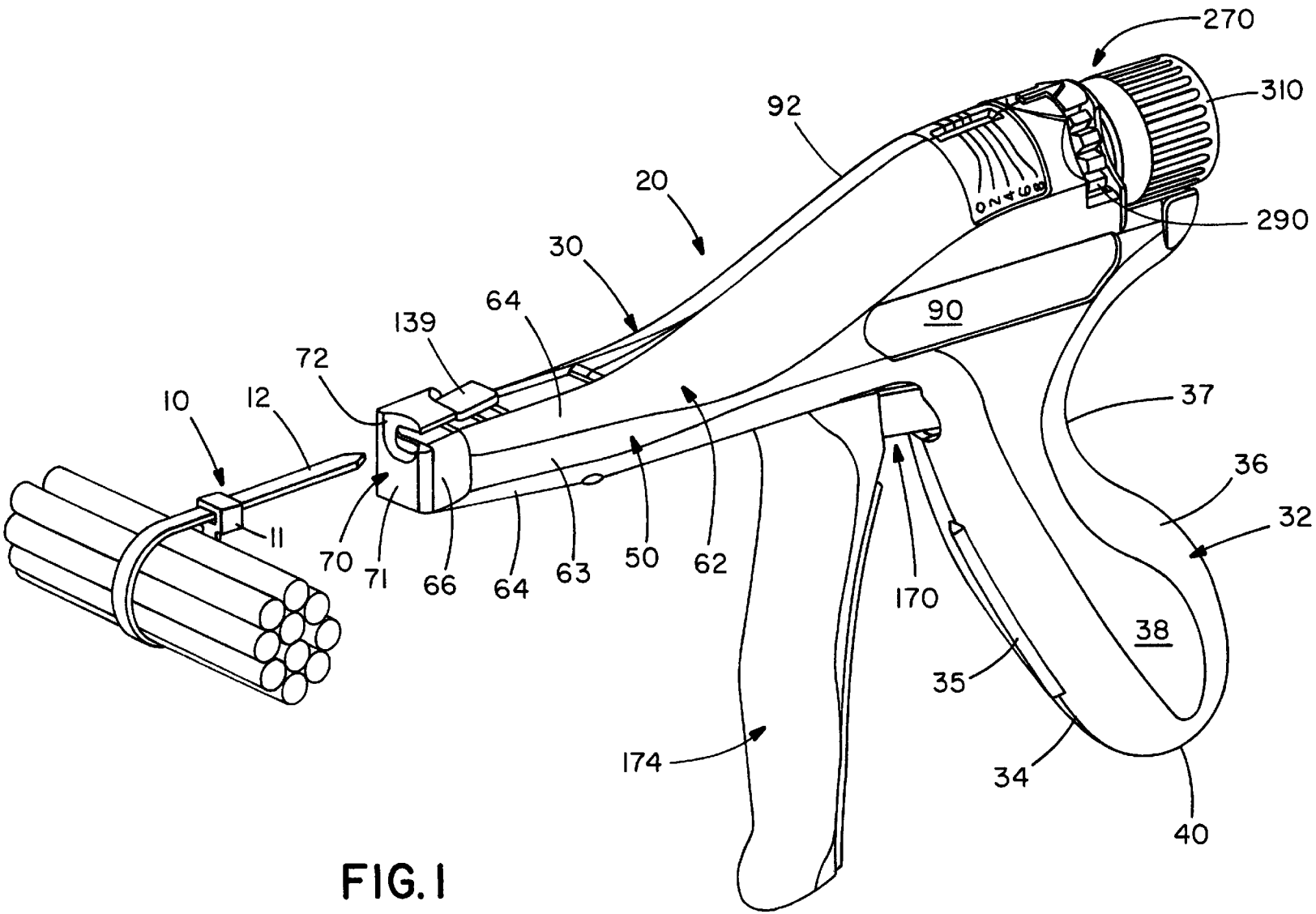
FIG. 1 is a left side perspective view of the tool embodying the present invention, the tool being illustrated in the condition wherein it is ready to receive a cable tie of the general kind referred to above and the tool is about to be actuated to tighten or tension the tie about a bundle.
Figure 2:
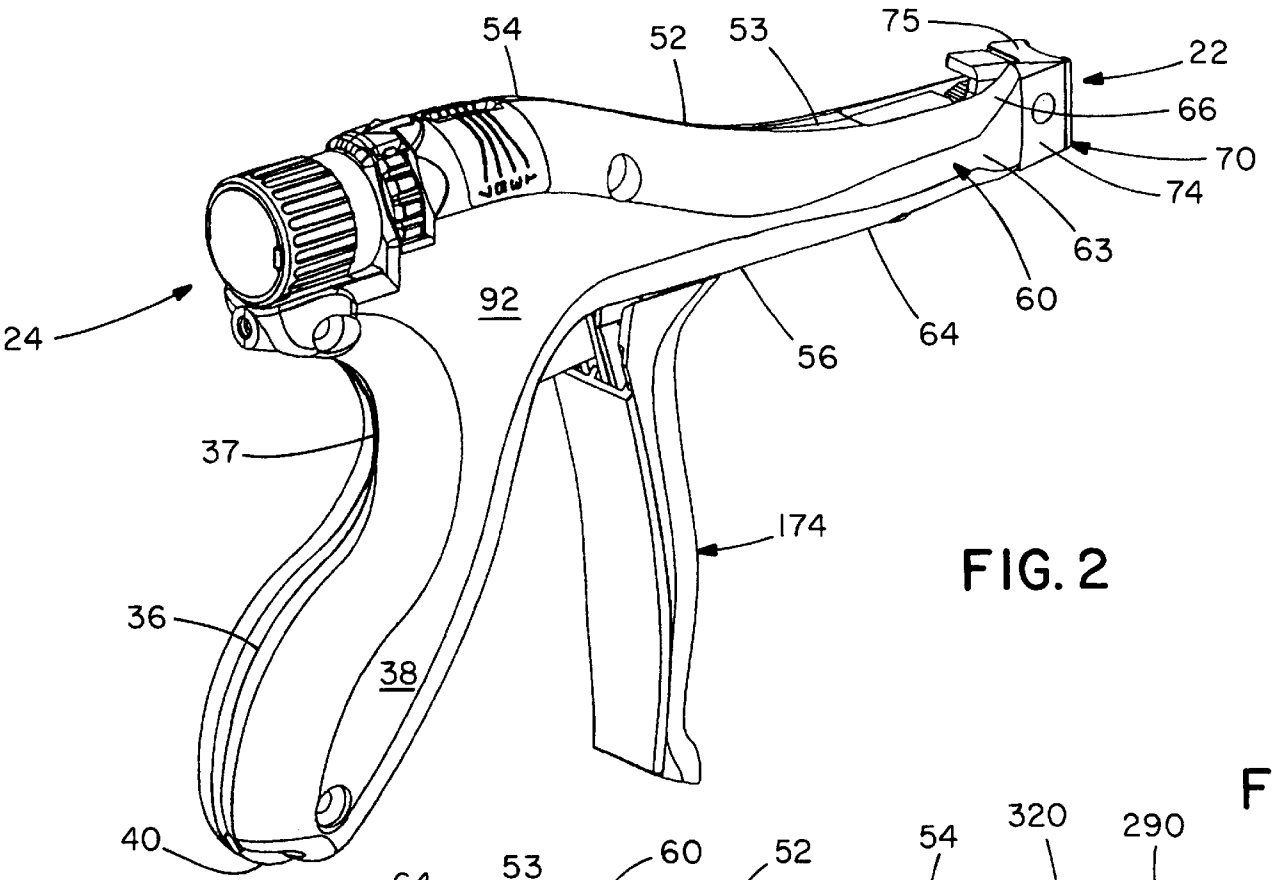
FIG. 2 is a right side perspective view of the tool of FIG. 1, with the strap and bundle being omitted.
Figure 3:
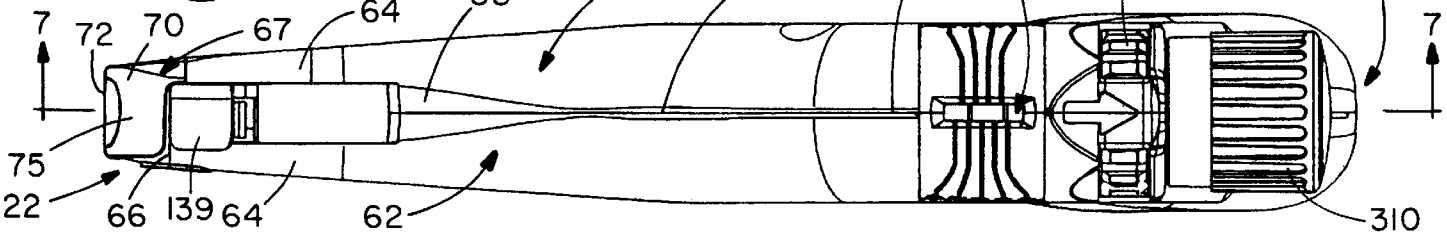
FIG. 3 is a top plan view of the tool of FIG. 1.
Figure 4:
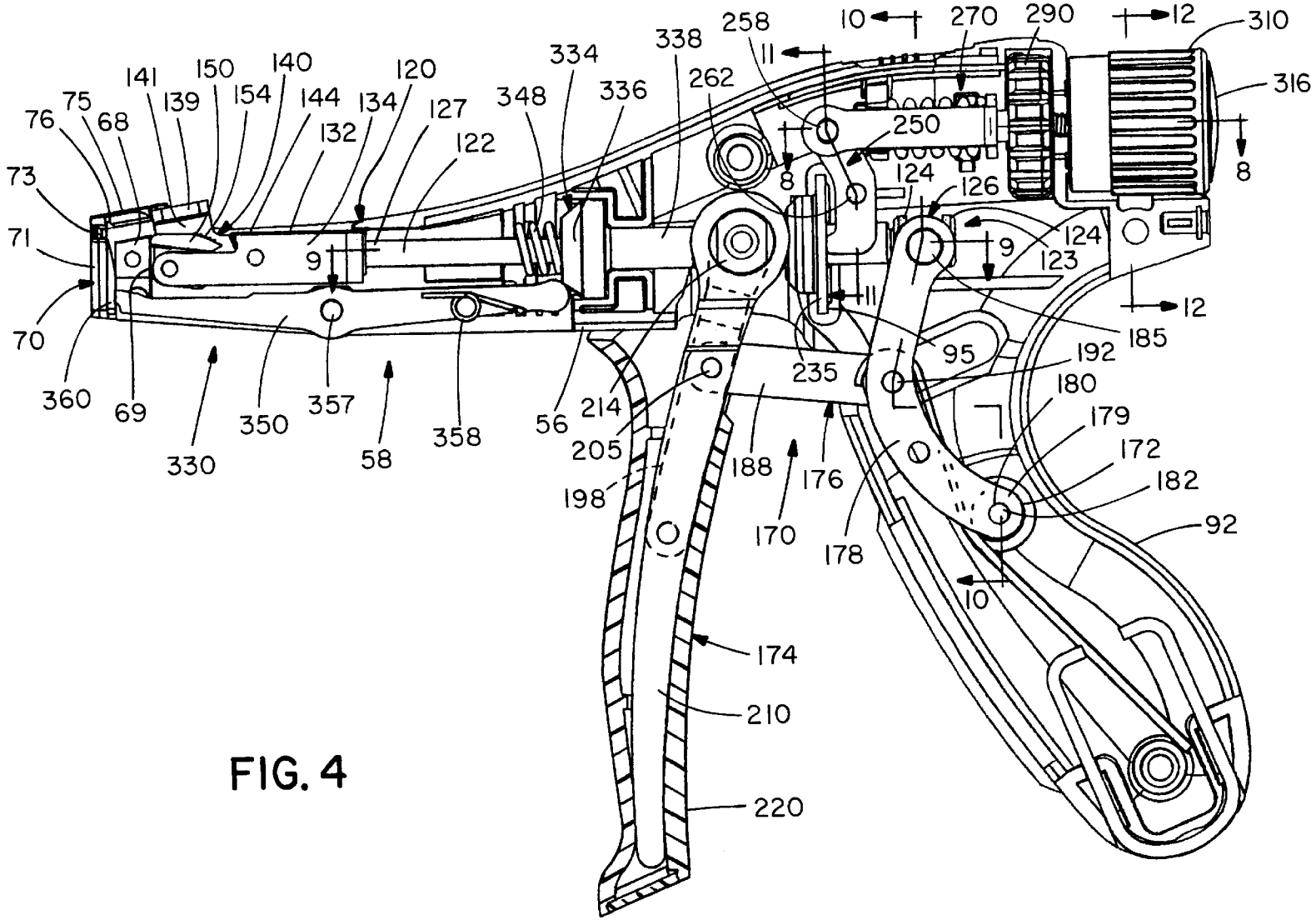
FIG. 4 is a side elevation view of the tool of FIG. 1, with the left hand side body housing removed.
Figure 5:
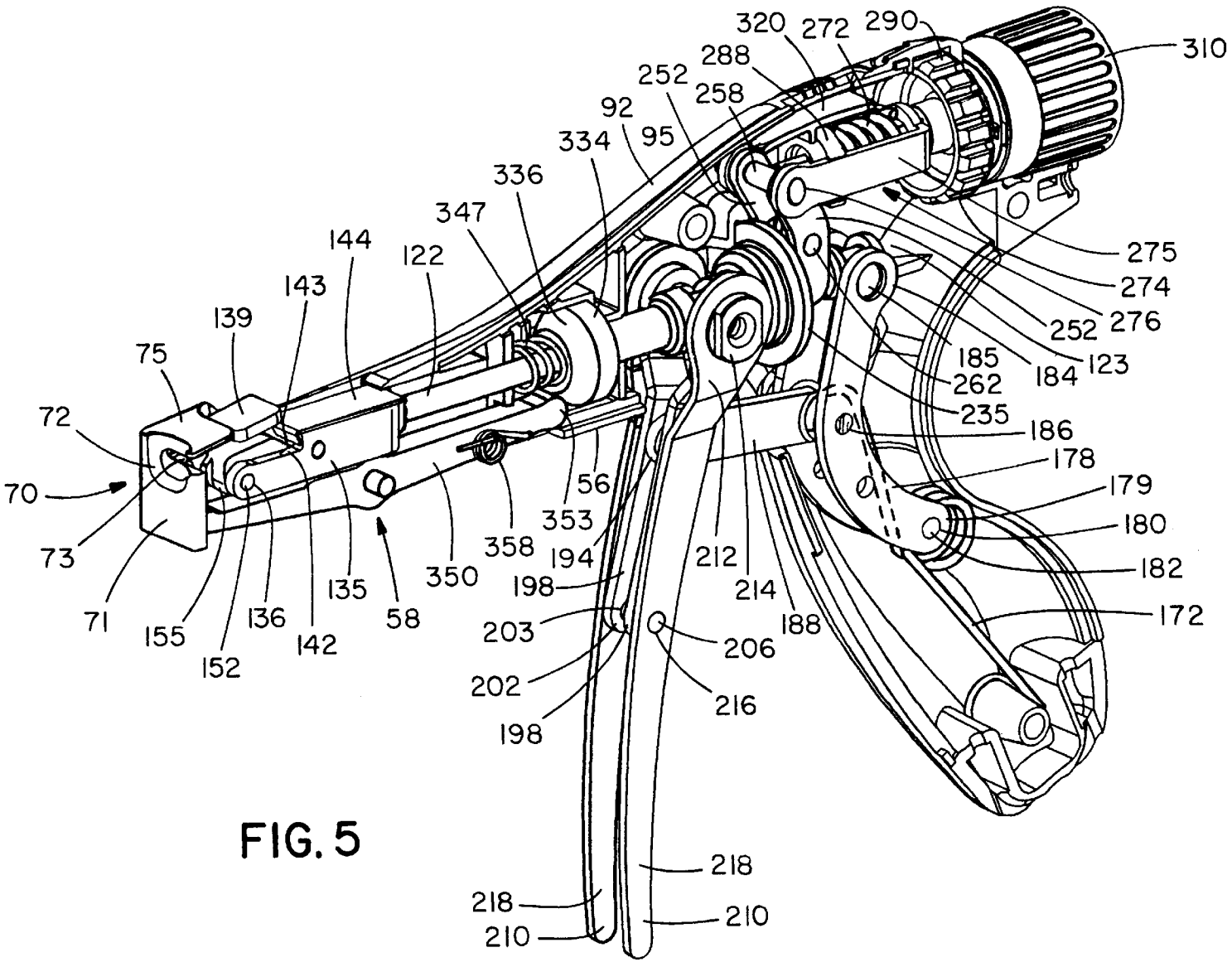
FIG. 5 is a left side perspective view of the tool of FIG. 4.
Figure 6:
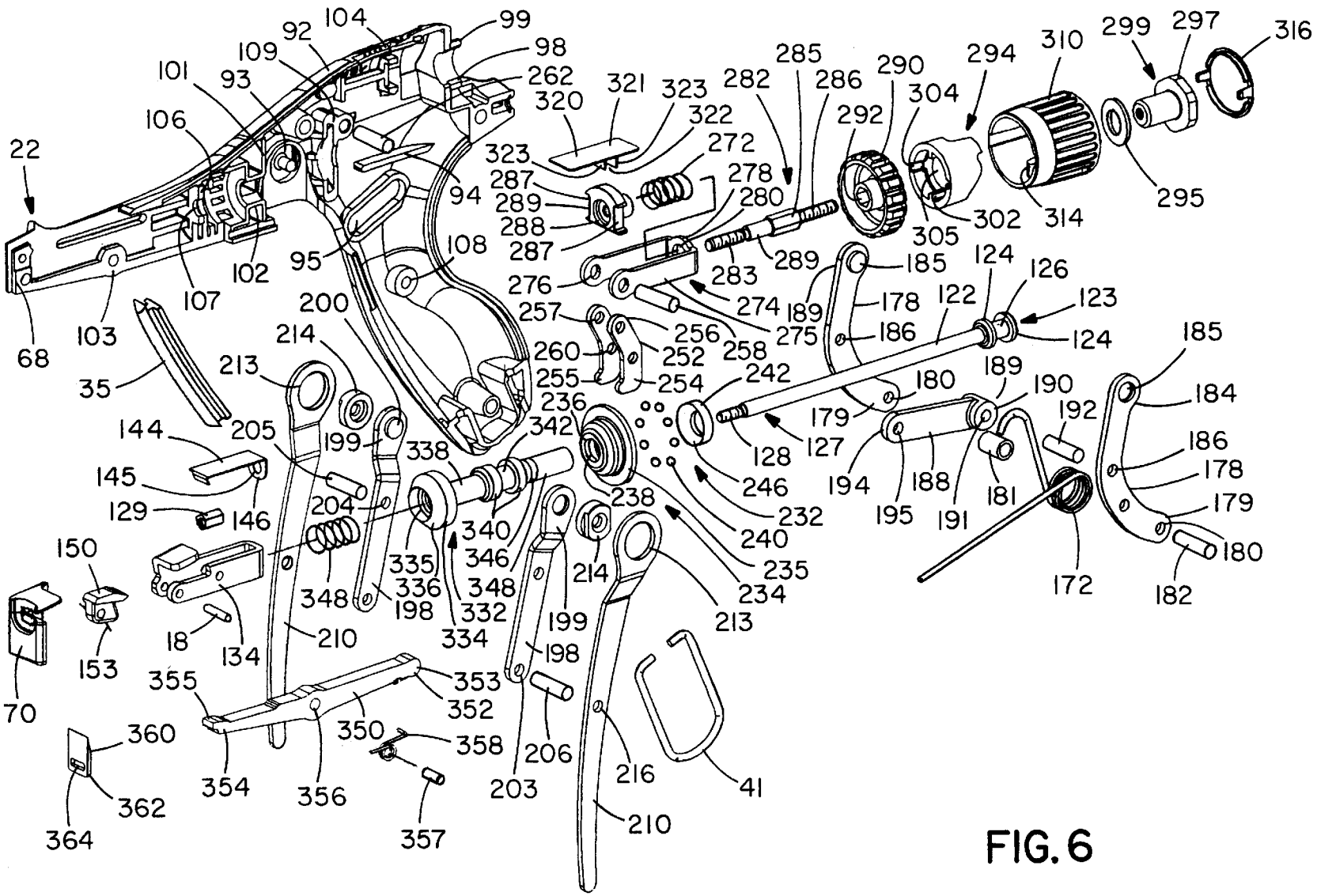
FIG. 6 is an exploded perspective view of the tool of FIG. 1.

A tool for installing a cable tie embodying the concept of the present invention is designated generally by the reference numeral 20 in the accompanying drawings. As shown in FIGS. 1–3, the hand-held tool 20 has a housing 30 having a handle portion 32 and a barrel portion 50. The housing 30 includes two separate complimentary sidewall portions 90 and 92 that are secured together to define the handle portion 32 and the barrel portion 50. The handle portion 32 has a front 34, a back 36, opposite sides 38 and 39, and a bottom 40. In the illustrated embodiment, the sides 38 and 39 are generally arcuately-shaped desired ergonomic design and substantially mirror images of one another. The back 36 is also correspondingly arcuately-shaped including a deeply recessed portion 37 which is included to enhance the ergonomics of the tool 20. The front 34 is also arcuately shaped, however, less dramatically so than the back 36, and includes an impact absorption pad 35 which also increases the ergonomics of the tool 20 by reducing shock and vibration to the operator. The bottom 40 has a curvilinear surface generally similar to a hemispherical configuration, joining the sides 38 and 39, front 34 and back 36 together at a common point on the lower extension of the handle.

The barrel portion 50 has a top 52, a bottom 56, and opposite sides 60 and 62. In the illustrated embodiment, the top 52 is generally characterized as having a semicircular configuration extending from the handle portion 32 to the distal end 22 of the tool 20 with a planar top portion 53 formed near the distal end 22. The top 52 also includes a raised surface 54 further away from the bottom 56 than the planar portion 53, which raised surface 54 is integral with the sides 60 and 62 adjacent the handle portion 32. The opposite sides 60 and 62 each have a small planar elements 63 disposed thereon extending from the distal end 22 of the tool 20 toward the handle 32 for a certain distance. Additional curvilineal surfaces 64 disposed above and below, respectively, the substantially planar elements 63. The bottom 56 is substantially planar in configuration generally parallel to the planar top portion 53. A substantially rectangular-shaped aperture 58 is provided therein in order to accommodate elements of the cutting mechanism 330.

In FIGS. 4–7, one side wall 90 of housing 30 has been cut away or removed to show the other housing sidewall 92 interior and the internal parts and mechanisms. The housing 30 generally contains a reciprocating tensioning mechanism 120, formed by a preferably cylindrically-shaped tension rod 122 and a gripper assembly 132 disposed at the distal end of the tension rod 122 for gripping the tie tail 12 of cable tie 10. The tension rod 122 extends substantially along the longitudinal axis 26 of the barrel portion 50. The tensioning mechanism 120 is operatively connected to an actuating mechanism 170 by means of a mechanical linkage assembly 176 and a manually operated trigger 174. The actuating mechanism 170 is also operatively connected to a restraining mechanism 230, and to a tie cutting mechanism 330.

The tool 10 includes a blade guard 70 fixed to the front 66 of the tool barrel 50. In the preferred embodiment, the blade guard 70 is made of metal. More particularly, the blade guard 70 is manufactured by a metal injection process for strength at a lower cost. The blade guard 70 includes a forward planar surface 71 facing away from the tool barrel 50. Formed thereon is an arcuately-shaped recessed element 72 for receiving a variety of differently sized cable tie heads of various different curvilinear shapes. The blade guard 70 also includes a tie slot 73 through the forward planar surface 71, through which the tool operator passes a tie tail 12 of a cable tie 10 after the tail 12 has been first passed around a bundle of wires 13 and threaded through the cable tie head 11.

As shown in FIGS. 4–7, the tool 20 includes a tensioning mechanism 120 which in turn includes a tension rod 122 and a gripper assembly 132. In the preferred embodiment, the tension rod 122 is generally cylindrical along its longitudinal extent. A pair of shoulders 124 define a channel 126 subsequently formed at the proximately disposed end 123. A set of threads 128 are likewise formed at the distal end 127 of the rod 122. The gripper assembly 132 includes a housing 134, a cover 144 and the pawl 150. The pawl 150 is secured in the housing 134 by means of a pin or shaft 152 and biased to grip the cable tie tail 12 by a spring 153 as is well known to those of skill in the art. The housing 134 is secured to the distal end 127 of the tension rod 122 by a nut 129 which engages a set of threads 128 disposed at the distal end 127 of the tension rod 122 after the tension rod 122 has been inserted through an aperture 138 in the end plate 137 thereof. Prior to the nut 129 being secured to the distal end 127 of the tension rod 122, the cover 144 having an aperture 145 disposed on the end panel 146 thereof is mounted over the distal end 127 of the tension rod 122. The tie tail 12 is engaged by the pawl 150. The pawl 150 has a plurality of tie tail gripping teeth 154. The pawl 150 extends out of the housing 134 through a generally rectangular aperture 140 disposed below the cable tie pressure plate 139, which aperture 140 extends between the distal end of the cover 144 and the distal end of the housing 134. The gripping teeth 154 are spaced apart and angled upwardly from the pawl 150. The gripping teeth 154 further have a depth and sharpness sufficient to enable the gripper to grasp the cable tie tail 12 on either a flat or serrated cable tie tail for tensioning purposes. The pawl 150 is biased for forward rotation toward the distal end 22 of the tool 20 about shaft 18 by a torsion spring 153 which engages the shaft 152 and the pawl 150. The pawl 150 applies the grasping pressure on the tie tail 12 held in a tie passageway 141 between the tie pressure plate 139 and the pawl 150.

The tool 20 further includes an actuating mechanism 170 including a mechanical linkage assembly 176 connecting the trigger 174 to the tension rod 122. By squeezing the tool trigger 174 the operator applies a force to the tension rod 122 in the direction of the proximate end 24 of the tool 20, thereby drawing the tie tail 12 back toward the proximate end 24 of the tool 20 and tensioning the tie 10 around the wires 13.

When the tool 20 is in its initial position (FIG. 7), the tensioning mechanism 120 and tension rod 122 are biased into their forward most extent within the tool barrel 50 by a return spring 172 located in the handle 32. In this position, the pawl 150 abuts a guide boss 68 of the barrel 50. The rear face 69 of the guide boss 68 engages the leading surface 155 of the pawl 150 when the tool trigger 174 is released after having been squeezed. The leading surface 155 is configured complimentary to that of the guide boss rear face 69 so that their interaction after the tie tail 12 has been severed and the tension rod 122 is returned, causes the leading surface 155 to engage and ride on the guide boss rear face 69 and rotate rearwardly to open the tie passageway 141 between the pawl 150 and the tie pressure plate 139, thereby allowing the severed tie tail 12 to easily fall out of the tie passageway 141.

The front end 66 of the right side of the barrel 50 includes a recessed portion 67, and the blade guard 70 further includes a side element 74 extending transversely rearwardly from the forward planar surface 71, which side element 74, when installed, is seated in the recessed portion 67. The side element 74, seated in the recessed portion 67, is generally flush with the right side of the barrel 50 rearward of the recess portion 74. The side element 74 is integral with the top element 75 and the forward planar surface 71. The top element 75 has an anvil 76 disposed for cooperating with the cutting mechanism 330, as described in U.S. Pat. No. 5,065,798 to Alletto et al., commonly assigned to Panduit Corp., and incorporated by reference herein.

During the tensioning stroke, the pawl 150 engages the tie tail 12 and pushes the tie tail 12 against the tie pressure plate 139, which results in the portion of the tie tail 12 rearward of the pawl 150 being angled upward away from the cover 144. By maintaining the tie tail 12 at the upward angle, the likelihood that the tie tail 12 will find its way into the tool 20 and jam the tool 20 is greatly decreased.

Figure 9:
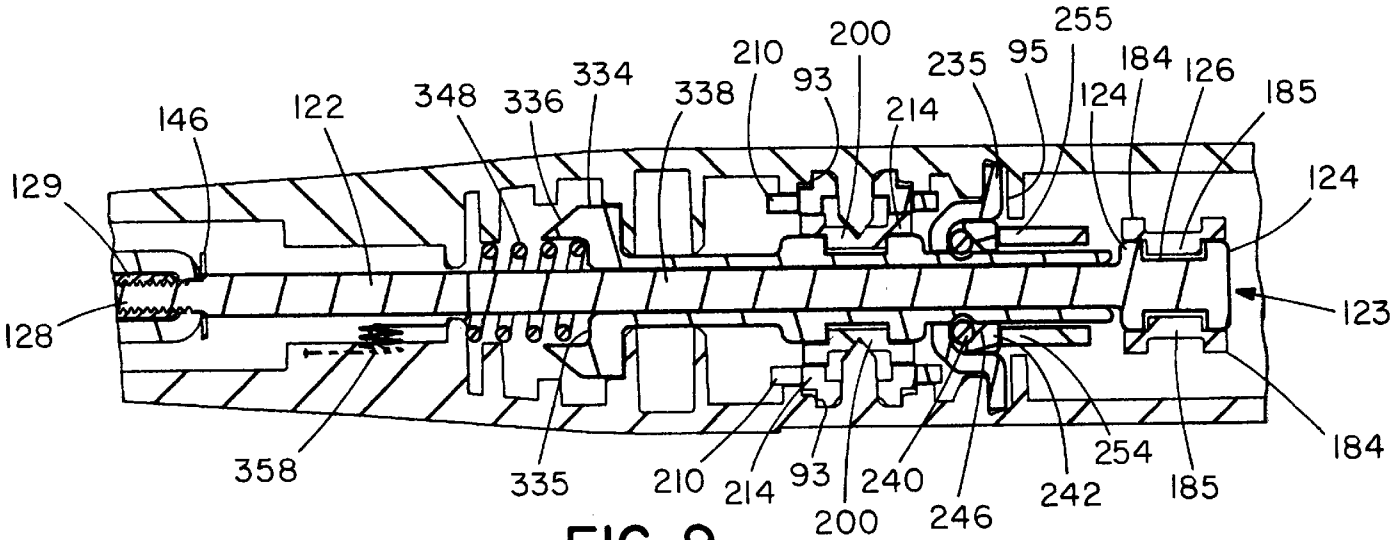
FIG. 9 is a fragmentary cross-sectional view taken through the tool substantially along the line 9—9 in FIG. 4.
Figure 10:
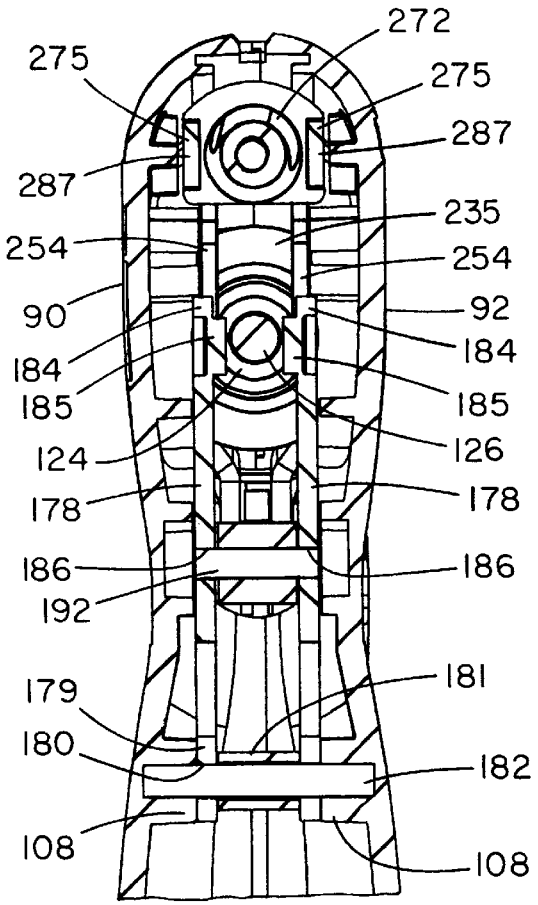
FIG. 10 is a fragmentary cross-sectional view taken through the tool substantially along the line 10—10 in FIG. 4.

The tensioning mechanism 120 is operatively connected to an actuating mechanism 170 which includes a linkage assembly 176. The actuating mechanism 170 includes a pair of tension links 178, the drive link 188, a pair of inner links 198, a pair of grip links 210, and a grip or trigger cover 220. The upward most end 184 of the substantially identical tension links 178 is manufactured to include a semi-perforation, semi-piercing or nib extension 185, preferably having a circular or cylindrical configuration, which extend inwardly toward one another to positively engage in a free floating fashion, a channel 126 formed at the proximate end 123 of the tension rod 122 (FIGS. 9 and 10). The channel 126 is defined by a pair of shoulders 124 formed on the proximate end 123 of the tension rod 122.

At the opposite or lower end 179 of each tension link 178 is disposed an aperture 180 through which a pin 182 may be inserted and secured to each housing sidewall 90 and 92 to provide a pivot point for the tension links 178. A sleeve spacer 181 which has an inside diameter slightly greater than the pin 182 is positioned between the lower ends 179 of the tension links 178 to ensure proper separation, precise engagement of the semi-piercing 185 with the channel 126, and to enable the mounting of the proximate end 189 of the drive link 188 to an additional set of apertures 186 in the tension links 178 disposed at a desired location between the semi-piercings 185 and the pivot apertures 180.

As shown in FIGS. 9 and 10, a shaft 192 is inserted through the tension link apertures 186 and the mounting boss 170 of the drive link 188 to secure the proximate end 189 of the drive link 188 to the tension links in a freely rotatable manner. The opposite or distal end 194 of the drive link 188 is disposed between a pair of inner links 198 and secured thereto with a shaft 205 which is inserted through the aligned apertures disposed in each piece and permits rotational movement. The apertures 204 which receive the shaft 205 to positively secure the drive link 188 in location on the inner links 198 are disposed in a substantially central portion between an upper end 199 of each having a semi-perforation, semi-piercing or nib extension 200, as described above, and an aperture 203 disposed at an opposite lower end 202 for receiving a shaft 206 which pivotally secures the pair of inner links 198 to the substantially central portion of grip or trigger links 210. The grip links 210 extend substantially the length of the trigger 174 and, preferably, for a small desired amount further into the tool housing 30. The grip links 210 are pivotally mounted to the housing sidewalls 90 and 92, respectfully, by an aperture 213 of increased size formed at the upper end 212 of the grip links 210 which extend into the tool housing. The apertures 213 are disposed on a bushing 214 which is ultrasonically welded into a pocket 93 formed in each side housing 90 and 92. Preferably, a small amount of grease is applied to each bushing 214 which extends out of the pocket 93 a desired amount such that the grip links 210 pivot smoothly as is known to one of ordinary skill in the art.

Preferably, a series of raised projections 94 are provided on the inside surface of each side housing 90 and 92 to assist the alignment of the tension links 178 and control the amount of free play therein as the links travel through their movements. The semi-piercings 200 disposed at the upper end 199 of each inner link 198 are disposed in a channel 342 formed on a cutting mechanism sleeve 332 which is defined by a pair of shoulders 340 formed on either side thereof which generally position the semi-piercings 200 during operation, but allow for a free-floating configuration.

Figure 14:
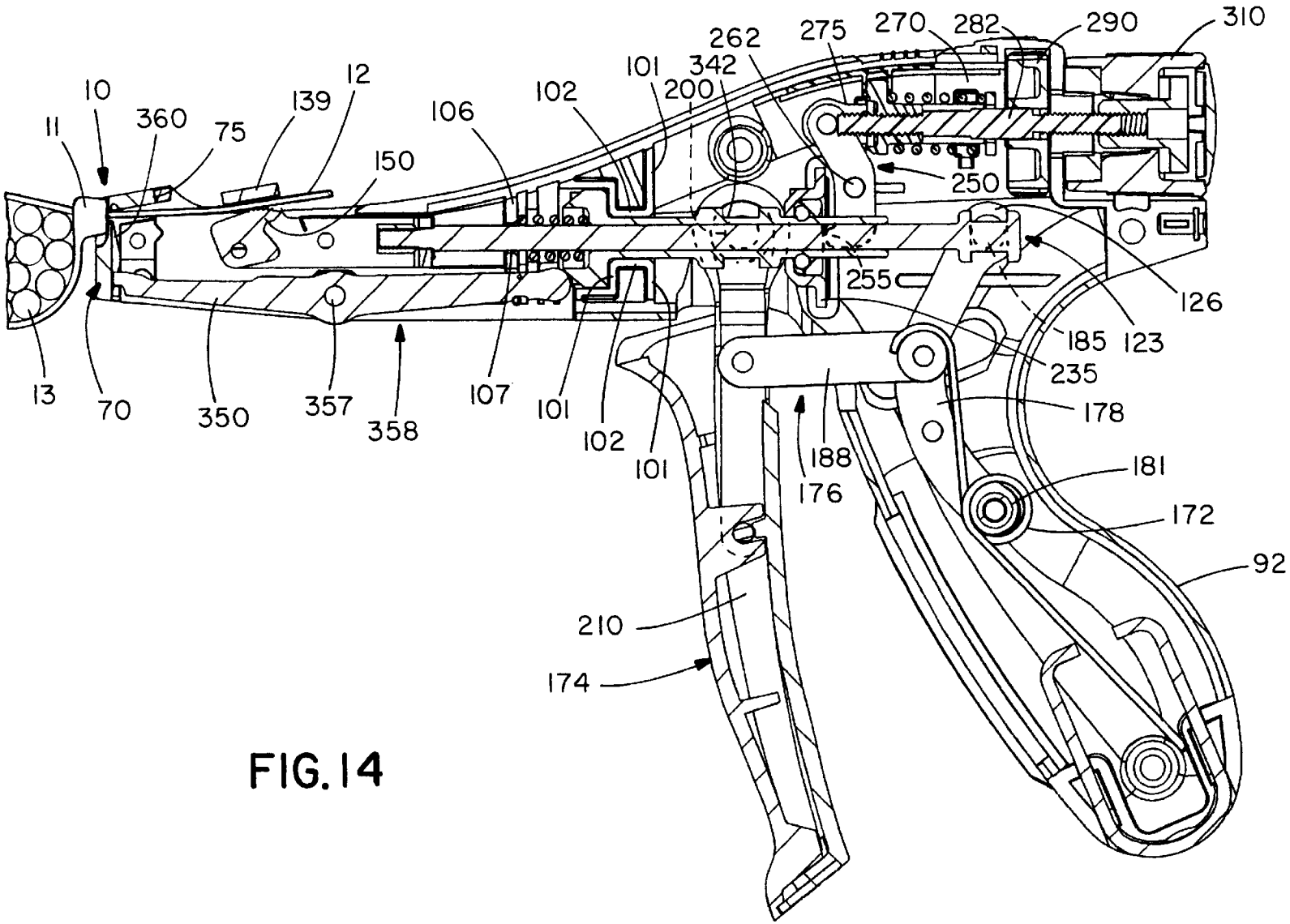
FIGS. 14 and 15 schematically illustrate the operation tool of FIG. 1, shown with the tensioning assembly coarse tension adjustment knob aligned in the low tension position.

The restraining mechanism 330 as shown in FIGS. 8–11 and 16, includes a ball detent assembly 232 and a tension adjustment assembly 270. The ball detent assembly 232 is generally comprised of a housing 234 which is substantially cup-shaped and has a flange portion 235 which radially extends from the cup-shaped bottom 236 thereof and preferably has an annular configuration. An aperture 238 is formed in the bottom of the cup 236 which is generally appropriately configured to accept only a proximate surface 344 of the cutting mechanism sleeve 332 therethrough, but retain other elements of the assembly. The flange portion 235 is positively secured to each side housing 90 and 92 when inserted into a complimentary-shaped semi-circular slot 95 formed in each side housing 90 and 92 which circumferentially retains the annularly-shaped flange portion 235 to prevent any longitudinal movement thereof. Preferably, rotational movement is also controlled however this is not critical. Disposed within the housing 234 is a plurality of ball bearings 240 and a seat 242. The ball bearings 240 are captured between the bottom 236 of the housing 234 and the seat 242 for securing the sleeve 332 in position during tensioning of the tie tail 12 until the desired predetermined tension setting in the tension adjustment assembly 270 is attained (FIG. 14). A complete detailed description of this operation will be explained below.

The seat 242 has a preferably planar, annularly-shaped proximate face 243. An aperture 244 is disposed there through which extends distally through the seat 242 with an increasing diameter which at its final extent nearly equals the outside diameter of the seat 242 at its distal end. The rate of diameter increase may change the force which is imparted on the sleeve 332 relative to the force stored in the tension adjustment assembly 270. Consequently, a circumferential restraining force is created when an angled or conical face of 246 of the seat 242 contacts the ball bearings 240 which imparts the stored force to the sleeve 332.

Figure 11:
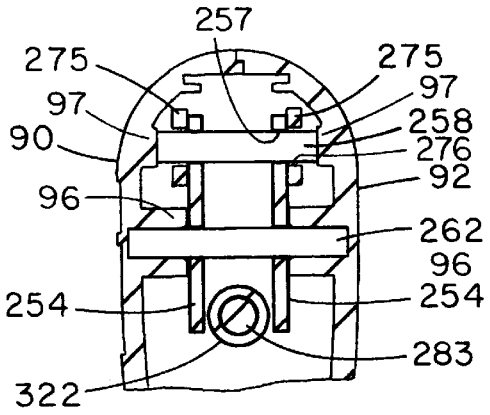
FIG. 11 is a fragmentary cross-sectional view taken through the tool substantially along the line 11—11 in FIG. 4.
Figure 12:
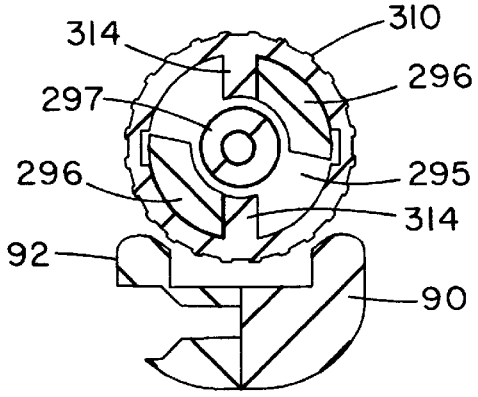
FIG. 12 is a fragmentary side cross-sectional view taken through the tool substantially along the line 12—12 in FIG. 4.

The tension adjustment assembly 270 is operatively connected to the ball detent assembly 323 by force transfer assembly 250. A pair of reversing links 252 pivotally mounted between the ball detent assembly 232 and tension adjustment assembly 270 comprises the force transfer assembly 250. A lower nib projection extending toward the distal end 22 of the tool 20 is disposed at the bottom or lower end 254 of each reversing link 252, positioned to contact diametrically opposite sides of the seat proximate annular face 243. In doing so, the reversing links 252 straddle the sleeve 332 and the tension rod 122 disposed therein. At a desired position above the nib 255, a pivot pin 262 is disposed in apertures 260 formed substantially in the central region in each link 252. As shown in FIG. 11, pin 262 is disposed in mounting bosses 96 of tool sidewalls 90 and 92. Thus, the reversing links 252 are positively mounted but free to pivotally rotate. One who is skilled in the art will recognize the balanced load carried by pin 262 resulting in less off center or cantilevered load transfer to the sidewalls 90 and 92.

Another shaft 258 disposed in to apertures 257 at the upper end 256 of each reversing link 252, operatively connects the force transfer assembly 250 to the tension adjustment assembly 270. Guide projections 97 are disposed on each side 90 and 92 along the travel path of the shaft 258 in order to maintain proper alignment of the reversing links 252 and prevent rotation of the tension adjustment assembly 270. Preferably, a light application of grease is applied to each guide projection 97 to ensure smooth tool 20 operation.

Figure 7:
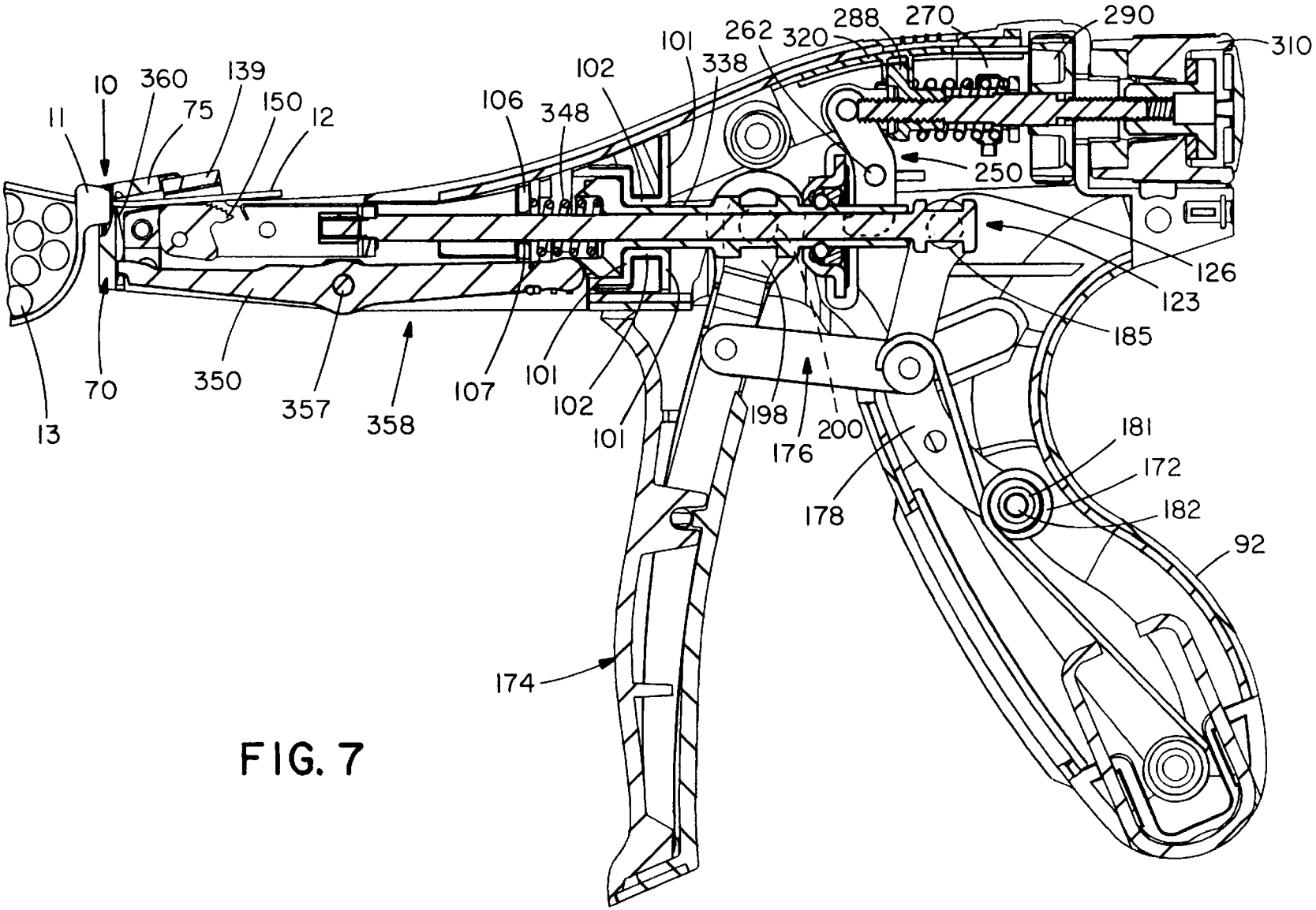
FIG. 7 is a fragmentary cross-section view taken through the tool substantially along the line 7—7 in FIG. 3.
Figure 8:
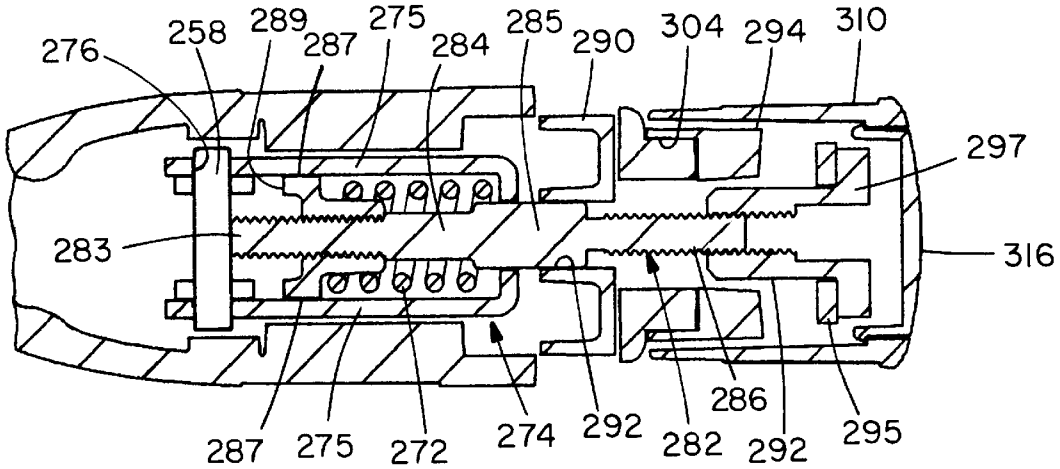
FIG. 8 is a fragmentary cross-sectional view taken through the tool substantially along the line 8—8 in FIG. 4.

FIG. 8 shows a preferred embodiment of the selective tension adjustment assembly 270 which includes a tension spring 222 held between two arms 275 of the yoke 274. The spring 272 encircles a tension shaft 282 axially disposed within the yoke arms 275. Shaft 258, described above, joins the yoke arms 275 together at the distal end of the yoke 274 by engaging apertures 276 disposed adjacent the distal end of the yoke, while the rear of the yoke 274 includes an end plate 278 which has a generally cylindrical opening 280 to accommodate passage therethrough of the tension shaft 282. The tension shaft 282 has a threaded portion 283 at its distal end which threadedly engages a threaded tension nut 288. The tension nut 288 has opposing slots 290 formed on the lateral edges 289 thereof which capture and ride along the yoke arms 275 and which prevent rotation of the tension nut 288 relative to the yoke arms 275. In the initial tool position (FIG. 7), the tension spring 272 is subjected to a slight preload or compression due to its placement between the tension nut 288 and the yoke end plate 278. It will be seen that any rearward movement of the tension nut 288 on the tension shaft 282 will increase the tension on the spring 272, and increase the force that the spring 272 exerts upon the reversing links 252, and ultimately the cutting mechanism 330 via the ball detent assembly 232.

Substantially disposed in the generally central portion of the tension shaft 282 is a preferably hexagonally-shaped section 285. As is obvious to those of ordinary skill in the art, this section 285 of the tension shaft 282 may have any number of flat portions as desired. Mounted on section 285 is a fine adjust knob 290 having a generally circular outer diameter configuration and an aperture 292 extending therethrough disposed about its center and shaped complimentary to the section 285. Preferably, a cam 294 is provided which is generally cylindrical in shape having a variety of pairs of cam surfaces 296, 298 and 300 disposed at different desired heights defining the top or proximate end of the cam. These various pairs of cam surfaces 296, 298 and 300 enable rough tension adjustment of the tool 20 when used in cooperation with the coarse tension adjustment knob 310.

The cam 294 further has at least one projection 302 extending a desired distance radially inward and at least one slot 304 extending radially outward into a wall of the cam disposed adjacent the distal end thereof. The projection 302 and slot 304 preferably engage complimentary slot 98 and projection 99, respectively, on the tool housing 30 to positively secure the cam in position and prevent any rotation or movement thereof. The tension shaft 282 also has a threaded portion 286 at its proximate end which threadedly engages a threaded calibration nut 294, for positively securing the coarse tension adjustment knob 310 to the tool 20 and permitting the operator to establish a baseline tension setting, accommodating for various production tolerances. A washer 298 is preferably provided, disposed between the head 297 of calibration nut 294 and a generally segmented disk-shaped flange 312 disposed interiorly of the proximate end of the coarse tension adjustment knob 310. Preferably, a cam follower 314 extends from each segmented disk flange portion 312, which cooperate with the various pairs of cam surfaces 296, 298 and 300 to provide immediate desired tension settings. A cover 316 is provided to enclose the proximate end of the coarse tension adjustment knob 310 to prevent dirt and other contaminants from reaching the calibration nut 294 and other internal parts and mechanisms.

Figure 13:
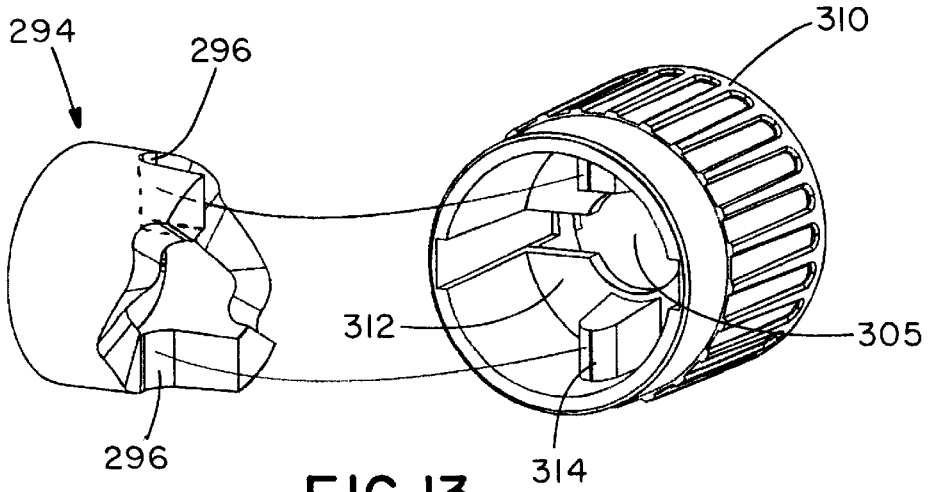
FIG. 13 is an enlarged, exploded view of the course tension adjustment knob and cooperating cam, shown aligned in the low tension position.
Figure 17:
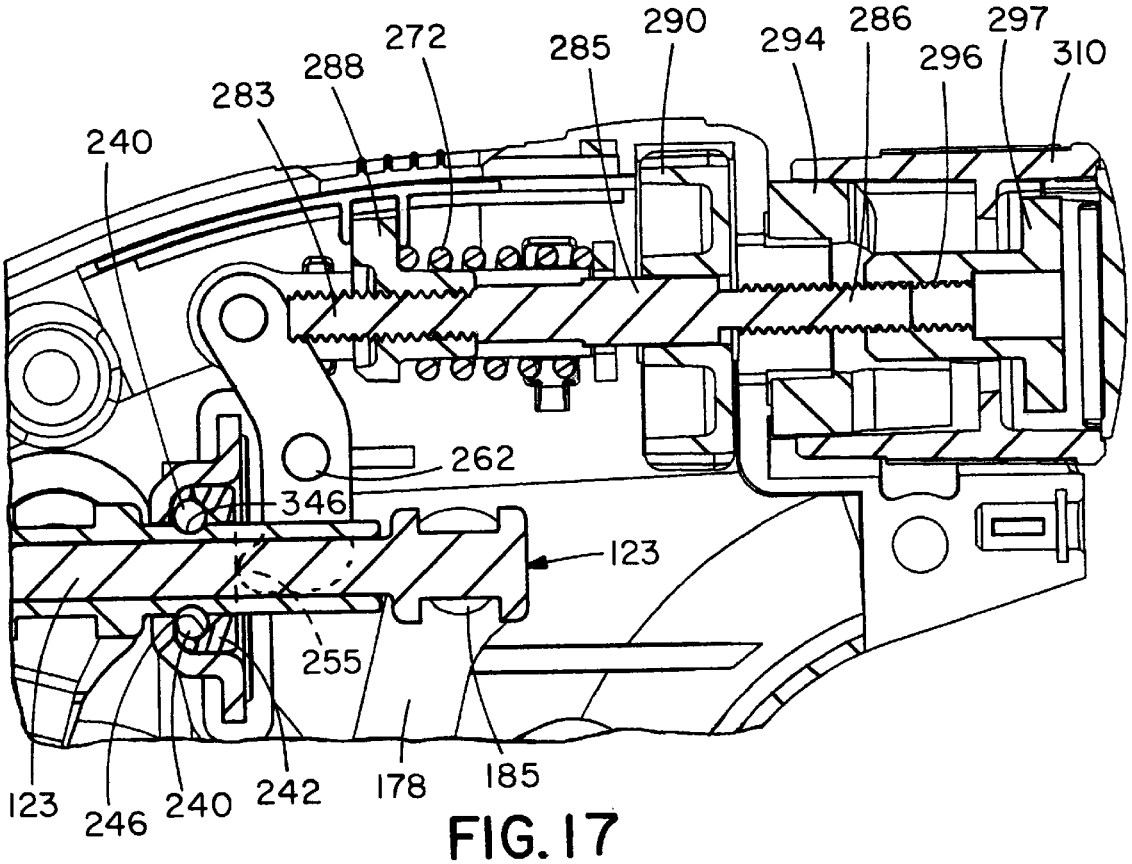
FIG. 17 is an enlarged side fragmentary view of the tensioning assembly of the tool of FIG. 1, shown with the coarse tension adjustment knob aligned in the medium tension position.
Figure 18:
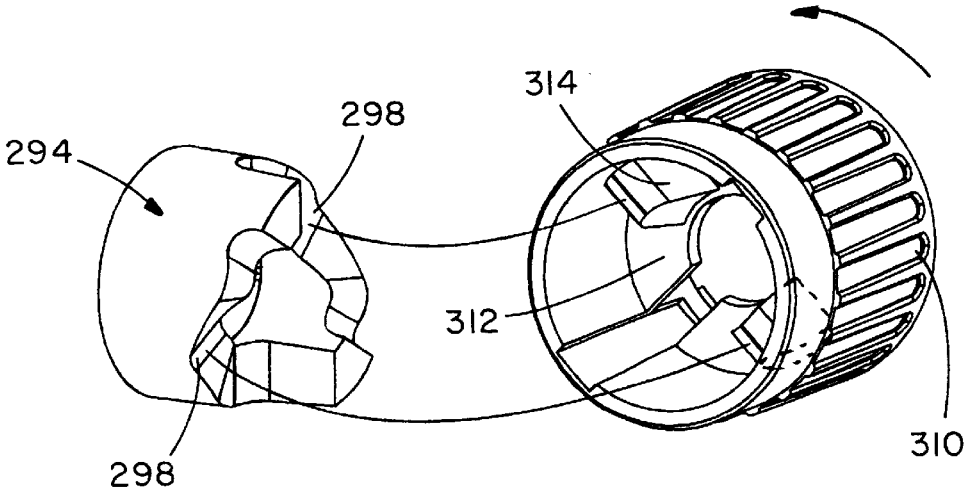
FIG. 18 is an enlarged exploded view of the coarse tension adjustment knob and cooperating cam, shown aligned in the medium tension position.
Figure 19:
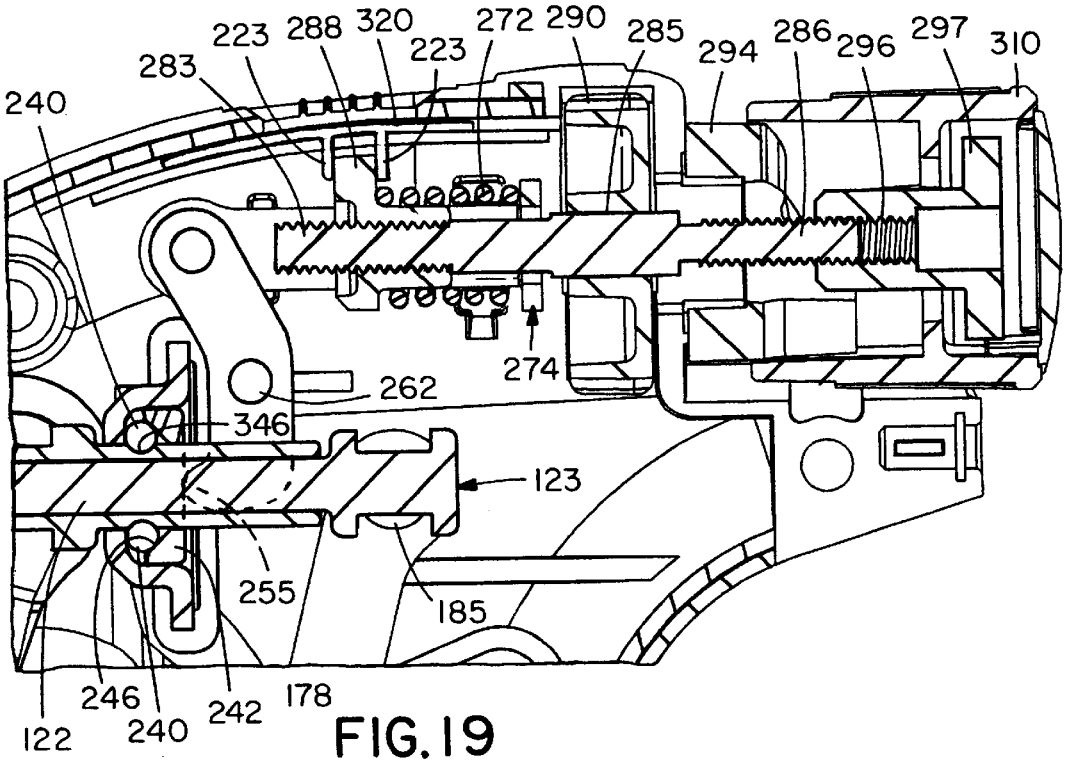
FIG. 19 is an enlarged side fragmentary view of the tensioning assembly of the tool of FIG. 1 shown with the coarse tension adjustment knob aligned in the high tension position.
Figure 20:
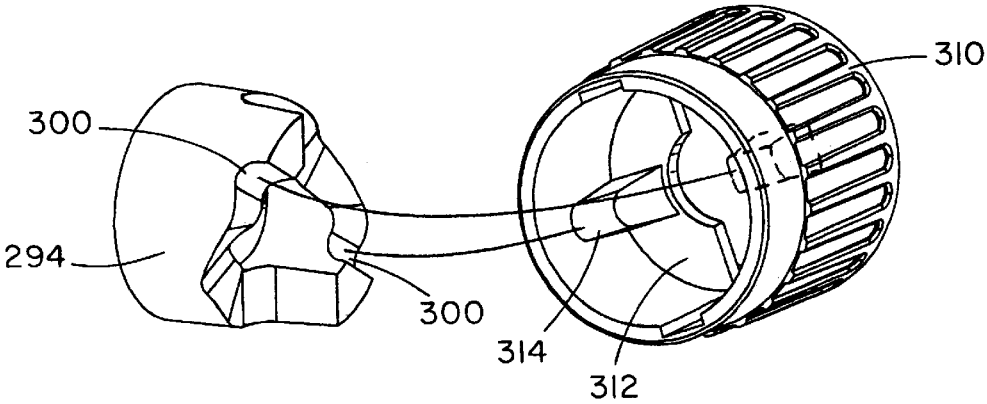
FIG. 20 is an enlarged exploded view of the coarse tension adjustment knob and cooperating cam, shown aligned in the high tension position.

Compression of the tension spring 272 is selectively increased by the operator rotating the coarse tension adjustment knob 310 which consequently rotates the cam followers 314. In the low tension setting (FIGS. 13 and 14), the cam followers 314 engage a first or low tension cam surface pair 296 to establish a preselected compression or preload of the tension spring 272. When the cam followers 314 engage the first cam surface pair 296, the distance between the tension nut 288 proximate face and the yoke endplate 278 is substantially at a maximum and thus the compression exerted on the tension spring 272 is at a minimum setting. Because the cam 294 is positively secured to the housing 30, when the coarse tension adjustment knob 310 is rotated from the low tension setting position (FIGS. 13 and 14) to the medium tension position (FIGS. 17 and 18) the tension nut 288 is drawn proximately toward the yoke endplate 278 (which is fixed in its location), a distance corresponding to the height of the first pair of cam surfaces 296 relative to the second pair of cam surfaces 298. As is obvious to one having ordinary skill in the art, the coarse tension adjustment knob 310 does not rotate the tension shaft 282 in order to move the tension nut 288, rather the coarse knob 310 pulls the tension shaft 282 and nut 288 toward the yoke end-plate 278. Turning the coarse tension adjustment knob 310 to the medium tension setting brings the cam followers 314 into engagement with the second pair or medium tension cam surfaces 298 which increases the compression on the spring 272 (and decreases the distance between the tension nut 288 and yoke endplate 278) by an amount equal to the extent of the first cam pair surfaces 296 relative to the second cam pair surfaces 298. As one of skill in the art will recognize, further rotation of the coarse tension adjustment knob 310 to the high tension setting (FIGS. 19 and 20) results in engagement of the third cam pair surfaces 300 by the cam followers 314, further increased compression of the spring 272 and further decreased distance between the tension nut 288 and yoke endplate 278. Increasing the compression in the tension spring 272 in this manner increases the circumferential restraining force applied to the ball detent assembly 232 via the force transfer assembly 250 and ultimately the tension in the tie tail 12.

A second or fine tension adjustment knob 290 is provided so that the operator has a means for finely adjusting or "fine tuning" the tension values chosen by rotation of the coarse tension adjustment knob 310. The fine tension knob 290 includes an aperture 292 extending axially therethrough which is shaped complimentary to the central portion 285 of the tension shaft 282, preferably hexagonal as in this preferred embodiment. Consequently, the fine tension knob 290 is fixedly attached to the tension shaft central portion 285 so that the shaft 282 and fine tension knob 290 are co-rotatable. Thus, rotation of the tension shaft 282 moves the threaded tension nut 288 a slight distance proximally or distally on the distal threaded shaft portion 282, depending on the direction of rotation of the fine tension knob 290. The tension shaft 282 extends axially through coaxial bore opening 305 and 318 in the cam 294 and coarse tension adjustment knob 310, respectively, such that when the shaft 282 is rotated by turning the fine tension adjustment knob 290, the shaft 282 does not rotatably engage the coarse tension adjustment knob 310 or cam 294. The proximate threaded portion 286 of the tension shaft 282 merely threads in or out of the calibration nut 294 freely, without rotating the coarse tension adjustment knob 310. The distal end 283 of the tension shaft 282 is threaded for a distance limited by a stop 284. The stop 284 limits the extent of travel of the tension nut 288 on the distal end 283 of the tension shaft 282, and correspondingly limits the amount of fine tension adjustment in the compression of the spring 272. By turning the fine tension adjustment knob 290, the operator can slightly increase or decrease the spring length between the tension nut 288 and the yoke endplate 278.

FIG. 7 shows a preferred embodiment of a cutting mechanism 330 which comprises a sleeve 332, return spring 348, lever arm 350, spring 358, severing blade 360, blade guard 70 and anvil 76. The sleeve 332 is substantially cylindrically-shaped with the bore 333 axially extending therethrough configured to receive and support the tension rod 122 in the desired alignment. Bearing or operating surfaces 100 for the sleeve are provided by the housing 30 and ball detent assembly 232. The housing sides 90 and 92 each have a pair of generally semi-circular projections 101 joined by a resulting cylindrically-shaped bearing surface 102. The distal bearing surface 338 of the sleeve 332 is preferably slightly smaller in diameter than the housing bearing surface 102 and consequently the sleeve 332 may be longitudinally actuated over the bearing surface 102 with little effort. Disposed adjacent the sleeve distal bearing surface 338 is the head 334 of the sleeve 332 which cooperates with a return spring 348 and the lever arm 350. A cylindrically shaped pocket 335 is formed in the head 334 of the sleeve 332 to receive and position a return spring 348, which biases the sleeve 332 proximally after severance of the tie tail 12. Additionally, the return spring 348 reduces the impact shock to the operator's hand when the sleeve 332 is released. This shock-absorbing effect enhances the ergonomics of the tool. The distal end of the spring 348 engages a wall 106 formed by opposing side walls 90 and 92 which has an aperture 107 therethrough for additional support of the tension rod 122 and gripper assembly 132. The distal face of the sleeve head 334 disposed exteriorly of the pocket 335 is angled in the proximate direction forming an annular activation face 336 for engagement with the lever arm 350.

Disposed proximately the distal bearing surface 344 is a channel 342 formed by a pair of shoulders 340, spaced apart a desired amount, which extend radially around the circumference of the sleeve 332. The channel 342 preferably tightly captures the semi-piercings 200 of the oppositely disposed inner links 198 in a free-floating configuration. Since the semi-piercings 200 are preferably circularly shaped a small tolerance free-floating engagement is achieved. In this construction, the actuating mechanism 170 may apply a constant force in the distal direction when the trigger 174 is pulled proximately and the tie tail 12 is being tensioned. Disposed proximately adjacent the channel 342 is the proximate bearing surface 344 of the sleeve 332 having a groove 346 formed in the substantially smooth exterior. The groove 346 extends around the circumference of the sleeve 332 at a desired position, and sized to substantially accept the plurality of ball bearings 240 disposed therein in the tool's 20 initial position.

The ball detent assembly 232 supports, guides and controls movement of the sleeve 332. The detent housing 234 provides a bearing element 238 at the distal or bottom of the cup 236 for the smooth cylindrical portion of the proximate bearing surface 344. The ball bearings 240 of the ball detent assembly 232 are circumferentially forced into the groove 346 and oppose the constant force applied by the inner links 198 and prevent movement of the sleeve 332 to actuate the cutting mechanism 330 until the desired predetermined tension setting is achieved. Further discussion of this operation will be included below.

The cutting mechanism lever arm 350 proximate end 352 has a generally arcuately or rounded shape protrusion 353 formed thereon. Preferably, a slight amount of grease provided thereon will allow smooth pivotal actuation of the lever arm 350 by the sleeve activation face 336. As the force applied to the sleeve 332 equals and then exceeds the desired tension setting, the ball bearings 240 of the ball detent assembly 232 are forced radially outward away from the groove 346, pushing the seat 242 proximately, thus overcoming the stored force in the tension adjustment assembly 270, the sleeve 332 may then be further urged by the inner links 198 in the distal direction and the proximate end 352 of the lever arm 350 will be forced toward the bottom 56 of the barrel 50. A laterally extending aperture 356 is provided at a desired position in the central portion of the lever arm 350 for receiving a pivot pin 357 therethrough which pin 357 is complimentarily sized to engage a pin boss 103 formed in each housing sidewall 90 and 92. The distal end 354 of the lever arm 350 includes a stepped or raised surface 355. The stepped surface 355 engages a slot 364 disposed on a lower end 362 of the severance blade 360. The severance blade 360 remains in position captured between the guide boss 68 and the blade guard 70 during movement of the lever arm 350 and engages an anvil 76 of the top element 75 after cutting the tie tail 12.

A means for visually indicating the adjustment level setting is shown generally as 320 in FIGS. 14–16, 17 and 19. A window 104 is provided in the top raised surface 54 of the tool housing 30 adjacent the tension adjustment assembly 270. Guide tracks 105 are formed in the housing sidewalls 90 and 92 and support a display plate 321 which is slidable in the tracks 105. Sliding display plate 321 is generally flat and has means for engaging the tension adjustment assembly in the form of a notch 322 defined by a pair of parallel depending projections 323. The notch 322 engages an upper extension 292 of the tension nut 288 and correspondingly moves therewith.

Figure 21:
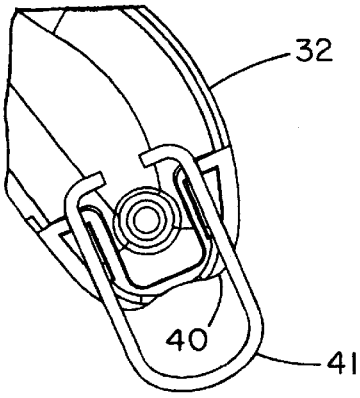
FIG. 21 is a fragmentary enlarged view of the lower portion of the handle of the tool of the FIG. 1.

The tool further includes a retractable bail 41 (FIG. 21) disposed to extend out of and retract into the bottom 40 of the handle 32.

Figures 15, 16:
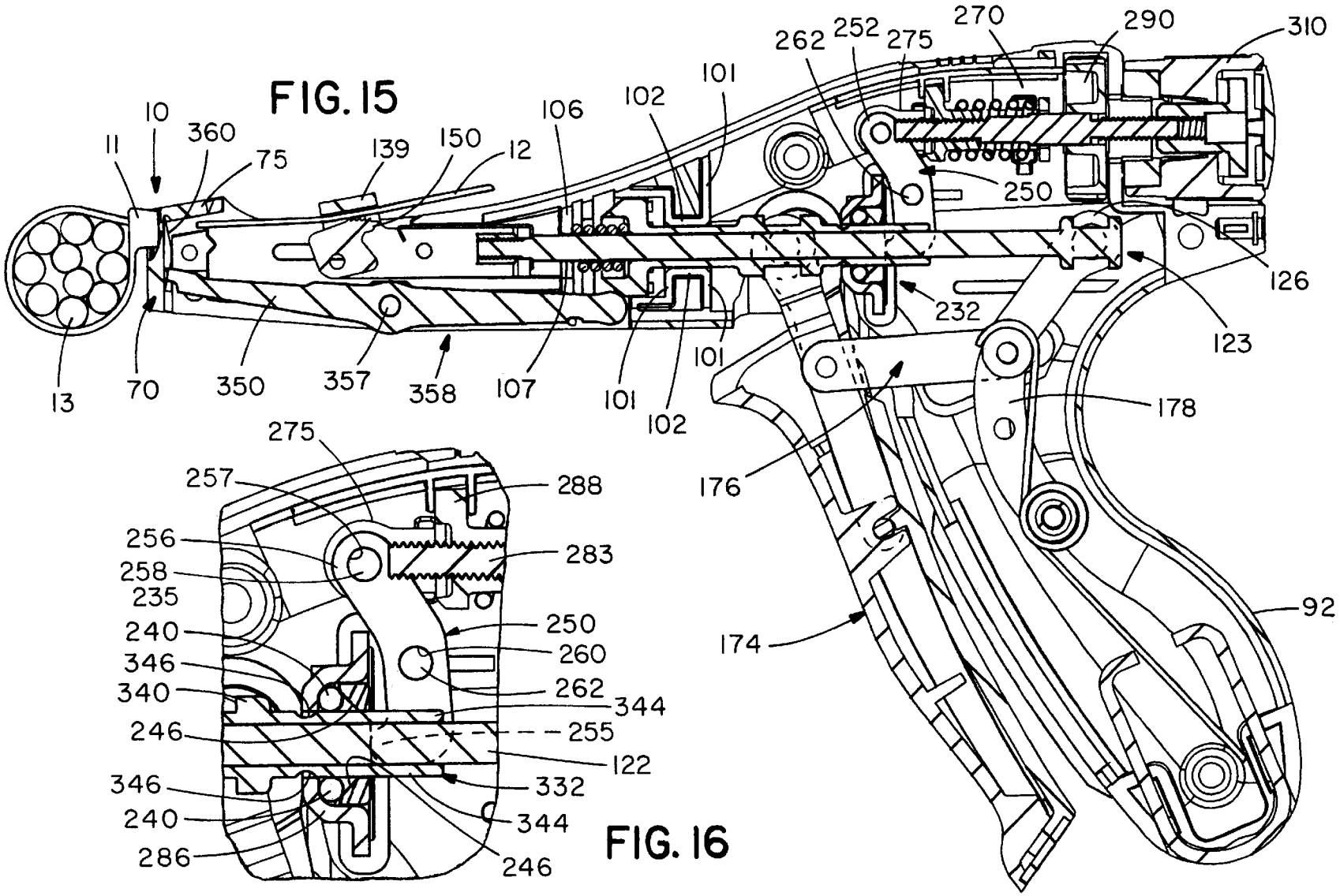
FIG. 16 is a fragmentary enlarged side view of the restraining mechanism shown in FIG. 15.

In operation, as shown in FIGS. 14–16, a cable tie tail 12, after having been wrapped around a bundle of wires or cables 13 and inserted through the cable tie head 11, is inserted into the tie slot 73 with the tool 20 at its normal, initial at-rest position, with the tie head 11 positioned adjacent the tie slot 73, and received within the recessed portion 72. The blade guard 70, guide boss 68 and cover 144 cooperate to orient the tie tail 12 upwardly away from the top 52 of the housing 30. As the trigger 174 is depressed by the operator toward the handle 32, the grip links 210 and the inner links 198 rotate around the central axis of the bushing 214, where the semi-piercings 200 and bushing 214 are coaxially laterally aligned at this point. During the trigger 174 movement a force is applied via the linkage assembly 176 to the tension rod 122 and a force oriented in an opposite direction is applied to the sleeve 332 via the inner link semi-piercings 200. The sleeve 332 is held stationary during tensioning by the restraining mechanism 230. As the gripper assembly 132 is drawn away from the guide boss 68, the pawl 150 rotates counterclockwise to capture the tie tail 12 between the pawl 150 and the pressure plate 139.

Generally, prior to achieving the desired predetermined tension setting, the inner links 198 attached to the grip links 210, push the drive link 188 rearwardly toward the proximate end of the tool 20 causing the tension links 178 to rotate about their respective pivot pin 182. The semi-piercings 185 present at the upper end 184 of the tension links 178 positively engage the channel 126 formed on the tension rod 122 and likewise draw the tension rod 122 rearwardly or toward the proximate end 24 of the tool 20 in a linear fashion. The sleeve 332 remains stationary in its initial position with the ball bearings 240 engaging the groove 346 and exerting a circumferential force thereon equal to the force stored in the tension adjustment assembly 270 as long as the force imparted to the sleeve 332 is less than the force stored in the tension adjustment assembly 270. When the desired predetermined tension setting is achieved in the cable tie 10 or more accurately when the force imparted to the sleeve 332 in the distal direction by the inner links 198 exceeds the force stored in the tension adjustment assembly 270, the ball bearings 240 are forced out of the groove 346 in the sleeve 332. The force stored in the tension adjustment assembly 270 is overcome when the ball bearings 240 are forced out of the groove 346 and push the seat proximately back slightly, which causes the force transfer assembly 250 to temporarily further compress the tension spring 272. As the operator continues to pull on the trigger 174, the inner links 198 push the sleeve 332 distally forward causing the activation face 336 to impart a force on the lever arm 350 which pivots the lever arm 350 raising the stepped surface 355 and the severing blade 360 upwards and cutting cable tie 10. The tool 20 resets to its normal position through the biasing action of the lever arm spring 358, sleeve return spring 348 and handle return spring 172. The cable tie tail 12 is released after cutting as described above.

While the preferred embodiments of the invention have been shown and described, it will be obvious to those skilled in the art that changes and modifications may be made therein without departing from the spirit of the invention, the scope of which is defined by the appended claims.

What is claimed is:

1. A tool for installation of a cable tie, said cable tie having a tie head portion and an elongate tie tail portion extending therefrom, said tool comprising:

a housing, said housing operatively supporting a tensioning mechanism for tensioning said cable tie to a predetermined tension setting and a cutting mechanism for severing an excess portion of said tail from said tension cable tie;

an actuating mechanism operatively supported by said housing and operatively connected to said tensioning mechanism and said cutting mechanism for actuating said tensioning and cutting mechanisms; and means for exerting a circumferential force on said cutting mechanism which prevents movement of said cutting mechanism prior to said cable tie tension reaching said predetermined tension setting, whereupon said means yields, releasing said cutting mechanism to sever the cable tie tail from the cable tie head.

2. The tool according to claim 1, wherein said tensioning mechanism further comprises a linearly reciprocating tension rod, extending and retracting substantially along a longitudinal axis of the tool, and a gripper assembly, connected to said tension rod, disposed adjacent a tool nose.

3. The tool according to claim 2, wherein said gripper assembly further comprises a spring biased pawl.

4. The tool according to claim 2, wherein said tension rod further comprises a channel defined by a spaced pair of shoulders disposed at a proximate end, and a threaded portion disposed at a distal end.

5. The tool according to claim 1, wherein said cutting mechanism further comprises a linearly reciprocating, generally cylindrical sleeve having a bore extending therethrough which coaxially, concentrically operatively associates with a linearly reciprocating tension rod of said tensioning mechanism, which extends and retracts substantially along a longitudinal axis of the tool.

6. The tool according to claim 5, wherein said sleeve further comprises a proximate bearing surface having a groove formed therein.

7. The tool according to claim 5, wherein said sleeve further comprises a generally centrally disposed channel defined by a pair of shoulders formed thereon, a distal bearing surface, and an enlarged head having an activation face disposed thereon.

8. The tool according to claim 6, wherein said groove is disposed on said proximate bearing surface complimentary to said means for exerting a circumferential force, wherein operative association of said groove and said means prevents movement of said sleeve prior to said cable tie tension reaching said predetermined tension setting.

9. The tool according to claim 7, wherein said activation face operatively associates with a pivotally disposed lever arm having a stepped surface at a distal end thereof which is operatively associated with a severing blade, wherein movement of said activation face distally depresses a proximate end of said lever arm which raises said severing blade to cut the cable tie tail from the cable tie head.

10. The tool according to claim 7, wherein said activation face is substantially configured frustoconically.

11. The tool according to claim 1, wherein said actuating mechanism further comprises a trigger and a linkage assembly operatively associated with said housing.

12. The tool according to claim 11, wherein said trigger further comprises a cover and a pair of grip links pivotally mounted to said housing, and said linkage assembly further comprises a pair of inner links disposed between said pair of grip links where each said inner link is operatively connected to an adjacent said handle link, a drive link operatively connected to said pair of inner links, and a pair of tension links pivotally mounted to said housing and operatively connected to a proximate end of said drive link.

13. The tool according to claim 12, wherein each said inner link further comprises a semi-piercing or semi-perforation nib operatively associated with a channel defined by a pair of spaced shoulders formed on a sleeve.

14. The tool according to claim 12, wherein each said drive link further comprises a semi-piercing or semi-perforation nib operatively associated with a channel defined by a pair of spaced shoulders formed on a tension rod.

15. The tool according to claim 1, wherein said means for exerting a circumferential force further comprises a tension adjustment assembly, a force transfer assembly, and a ball detent assembly.

16. The tool according to claim 15, wherein said tension adjustment assembly further comprises a yoke, a shaft, a tension nut, a spring, a fine tension adjustment knob, a cam, a coarse tension adjustment knob.

17. The tool according to claim 16, wherein said tensioning assembly further comprises a tension setting indicator.

18. The tool according to claim 15, wherein said ball detent assembly further comprises a cup-shaped housing mounted to said tool housing, with plurality of ball bearings, and a seat disposed therein.

19. The tool according to claim 18, wherein said ball bearings are operatively associated with a groove formed on a cutting mechanism sleeve.

20. The tool according to claim 18, wherein said seat has an angled face operatively associated with said ball bearings and a proximate face operatively associated with said force transfer assembly, whereby a force stored in said tension adjustment assembly is exerted on said proximate face resulting in circumferential force exerted by said ball bearings on a cutting mechanism sleeve which prevents movement of said cutting mechanism prior to said cable tie tension reaching said predetermined tension setting.

21. A tool for installation of a cable tie, said cable tie having a tie head portion and an elongate tie tail portion extending therefrom, said tool comprising:

a housing, said housing operatively supporting a tensioning mechanism for tensioning said cable tie to predetermined tension setting, a cutting mechanism for severing an excess portion of said tail from said tensioned cable tie, and a restraining mechanism for preventing actuation of said cutting mechanism prior to said cable tie tension reaching said predetermined tension setting;

said tensioning mechanism comprising at least a linearly reciprocating tension rod disposed substantially about a longitudinal axis of said tool;

said cutting mechanism comprising at least a substantially cylindrical sleeve; and said restraining mechanism comprising at least a ball detent assembly, whereby said ball detent assembly is mounted to said tool housing and has a generally cylindrical bore extending therethrough configured to coaxially, concentrically operatively associate with said sleeve which has a generally cylindrical bore extending therethrough configured to coaxially, concentrically operatively associate said tension rod.

22. The tool according to claim 21, wherein said tensioning mechanism further comprises a linearly reciprocating tension rod, extending and retracting substantially along a longitudinal axis of the tool, and a gripper assembly, connected to said tension rod, disposed adjacent a tool nose.

23. The tool according to claim 22, wherein said gripper assembly further comprises a spring biased pawl.

24. The tool according to claim 22, wherein said tension rod further comprises a channel defined by a spaced pair of shoulders disposed at a proximate end, and a threaded portion disposed at a distal end.

25. The tool according to claim 21, wherein said linearly reciprocating, generally cylindrical sleeve further comprises a bore extending therethrough which coaxially, concentrically operatively associates with said linearly reciprocating tension rod of said tensioning mechanism, which extends and retracts substantially along a longitudinal axis of the tool.

26. The tool according to claim 25, wherein said sleeve further comprises a proximate bearing surface having a groove formed therein.

27. The tool according to claim 26, wherein said groove is disposed on said proximate bearing surface complimentary to said ball detent assembly wherein operative association of said groove and said ball detent assembly prevents movement of said sleeve prior to said cable tie tension reaching said predetermined tension setting.

28. The tool according to claim 25, wherein said sleeve further comprises a generally centrally disposed channel defined by a pair of shoulders formed thereon, a distal bearing surface, and an enlarged head having an activation face disposed thereon.

29. The tool according to claim 28, wherein said activation face operatively associates with a pivotally disposed lever arm having a stepped surface at a distal end thereof which is operatively associated with a severing blade, wherein movement of said activation face, distally depresses a proximate end of said lever arm which raises said severing blade to cut the cable tie tail from the cable tie head.

30. The tool according to claim 28, wherein said activation face is substantially configured frustoconically.

31. The tool according to claim 21, wherein said tool further comprises an actuating mechanism including a trigger and a linkage assembly operatively associated with said housing.

32. The tool according to claim 31, wherein said trigger further comprises a cover and a pair of grip links pivotally mounted to said housing, and said linkage assembly further comprises a pair of inner links disposed between said pair of grip links where each said inner link is operatively connected to an adjacent said handle link, a drive link operatively connected to said pair of inner links, and a pair of tension links pivotally mounted to said housing and operatively connected to a proximate end of said drive link.

33. The tool according to claim 32, wherein each said inner link further comprises a semi-piercing or semi-perforation nib operatively associated with a channel defined by a pair of spaced shoulders formed on said sleeve.

34. The tool according to claim 32, wherein each said drive link further comprises a semi-piercing or semi-perforation nib operatively associated with a channel defined by a pair of spaced shoulders formed on said tension rod.

35. The tool according to claim 21, wherein said restraining mechanism further comprises a tension adjustment assembly, and a force transfer assembly.

36. The tool according to claim 35, wherein said tension adjustment assembly further comprises a yoke, a shaft, a tension nut, a spring, a fine tension adjustment knob, a cam, a coarse tension adjustment knob.

37. The tool according to claim 36, wherein said tensioning assembly further comprises a tension setting indicator.

38. The tool according to claim 35, wherein said ball detent assembly further comprises a cup-shaped housing mounted to said tool housing, with plurality of ball bearings, and a seat disposed therein.

39. The tool according to claim 38, wherein said ball bearings are operatively associated with a groove formed on said sleeve.

40. The tool according to claim 38, wherein said seat has an angled face operatively associated with said ball bearings and a proximate face operatively associated with said force transfer assembly, whereby a force stored in said tension adjustment assembly is exerted on said proximate face resulting in circumferential force exerted by said ball bearings on a cutting mechanism sleeve which prevents movement of said cutting mechanism prior to said cable tie tension reaching said predetermined tension setting.

* * * * *

UNITED STATES PATENT AND TRADEMARK OFFICE

CERTIFICATE OF CORRECTION

PATENT NO. : 6,206,053 B1
DATED : March 27, 2001
INVENTOR(S) : Larry Hillegonds

It is certified that error appears in the above-identified patent and that said Letters Patent is hereby corrected as shown below:

Column 15,
Line 20, “27” should be -- 28 --.
Line 26, “28” should be -- 27 --.
Line 31, “28” should be -- 27 --.
Line 38, “28” should be -- 27 --.

Signed and Sealed this

Eighteenth Day of March, 2003

JAMES E. ROGAN
*Director of the United States Patent and Trademark Office*